United States Patent [19]

Toelke

[11] 4,423,648

[45] Jan. 3, 1984

[54] PIPE ALIGNMENT TOOL

[75] Inventor: Lester W. Toelke, Houston, Tex.

[73] Assignee: International Tool and Supply Co., Inc., Houston, Tex.

[21] Appl. No.: 246,674

[22] Filed: Mar. 23, 1981

[51] Int. Cl.[3] ..... B25B 13/50

[52] U.S. Cl. ..... 81/57.34; 81/57.16; 81/57.18

[58] Field of Search ..... 81/57.15, 57.16, 57.18, 81/57.21, 57.34; 173/164; 166/212; 24/263 DA

[56] References Cited

U.S. PATENT DOCUMENTS

| | | | |
|---|---|---|---|
| 2,450,934 | 10/1948 | Calhoun | 255/35 |
| 2,950,639 | 8/1960 | Mason | 81/57.18 |
| 3,722,603 | 3/1973 | Brown | 81/57.16 |
| 3,748,702 | 7/1973 | Brown | 24/263 DA |
| 3,803,953 | 4/1974 | Geczy et al. | 81/53 |
| 3,806,021 | 4/1974 | Moroz et al. | 288/4 |
| 3,828,413 | 8/1974 | Province et al. | 29/200 |
| 3,838,613 | 10/1974 | Wilms | 81/57.34 |
| 3,874,518 | 4/1975 | Swoboda, Jr. et al. | 214/1 P |
| 3,976,207 | 8/1976 | Schultz | 214/2.5 |
| 4,161,807 | 7/1979 | Swenson | 24/263 DA |

*Primary Examiner*—James L. Jones, Jr.

*Attorney, Agent, or Firm*—Arnold, White & Durkee

[57] ABSTRACT

In accordance with an illustrative embodiment of the present invention, a pipe alignment tool comprises upper and lower pipe clamp assemblies connected together in axial alignment by hydraulic cylinders that are selectively operable to adjust the vertical separation of said clamp assemblies, a first set of slips on said upper clamp assembly for gripping and supporting an upper pipe joint, a second set of slips on said lower clamp assembly for gripping a pipe joint extending into the wall, and inclined surfaces on said slips and said clamp assemblies for tightening the engagement of said slips with the pipe joint that they engage in response to downwardly directed force.

14 Claims, 6 Drawing Figures

PIPE ALIGNMENT TOOL

FIELD OF THE INVENTION

This invention relates generally to apparatus for facilitating alignment, stabbing and threading of tubular members such as drill pipe or casing during running of the same into a well, and particularly to a new and improved pipe alignment apparatus that employs laterally shiftable slips to grip the pipe during alignment and threading operations.

BACKGROUND OF THE INVENTION

A long standing problem in the oil drilling industry is to properly align and then join or "make up" threaded tubular members that are being run into a well, particularly large diameter casing that is used to line the well. Prior procedures have involved the use of the cat line and a choke loop to lift pipe joints laying in the "V" door ramp up into the interior of the derrick and then lower the male or pin end of the joint toward the upward looking female or box end of a pipe joint previously run and left hanging in the slips in the rotary table. A member of a special casing work crew known in oil patch parlance as a "stabber" working on a catwalk called a "stabbing board" that is located some 30 to 35 feet above the rig floor attempts to maneuver the pipe and to judge whether it is properly aligned and ready to screw in. He may use various types of mechanical devices to pull the top of the pipe over while crew members below try to center it, all of which involves a certain amount of guesswork in addition to being somewhat hazardous duty since a joint of 20" casing may weight about 3,000–9,000 pounds.

During typical pipe stabbing operations, the driller will cause the lower threaded end of the suspended pipe joint to enter and engage the collar looking up, and then he will slack-off on the elevators to allow the full weight of the pipe to be set down on the threads. This procedure has made it quite difficult to properly mate the threads, and has caused galling cross threading and other thread damage. If the damage goes unnoticed and the pipe is lowered into the well, threaded joint failure can occur which may allow the pipe to break in two, or a leak can develop. Where the threaded connections are hydraulically tested, of course the discovery of a leak dictates that the joint be unscrewed and recoupled, resulting in lost rig time with attendant expense.

The foregoing problems are amplified when attempting to run casing or other tubular goods into a well from a floating drilling vessel that may pitch and roll in heavy seas.

An improved apparatus and method for aligning pipe sections to facilitate their threaded engagement in a more reliable and safe manner then has heretofore been known in the art is disclosed and claimed in my application Ser. No. 232,144, filed Feb. 6, 1981. The pipe alignment apparatus disclosed therein, while being basically sound in concept and overall approach to the problem, has the disadvantage that the rollers that are used to grasp the upper pipe joint may press into the periphery of the pipe when the apparatus is activated to an extent that it can be difficult to rotate the pipe as it is being lowered toward the suspended joint. Moreover, the roller axle and cam scroll ring system that is employed to enable lateral movement or the gripping means is subject to bending in use, and may be susceptible to unwanted structural damage, particularly when handling the larger and heavier casing sizes.

It is the general object of the present invention to provide a new and improved pipe alignment apparatus that includes laterally shiftable slip means to support and grasp the pipe during stabbing and threading operations.

SUMMARY OF THE INVENTION

This and other objects are attained in accordance with the concepts of the present invention through the provision of a pipe alignment apparatus comprising an upper clamp assembly and a lower clamp assembly that are connected to one another in axial alignment by adjustable means for controlling the amount of vertical separation of the assemblies. Each clamp assembly includes a relatively fixed segment and a pivotally mounted segment that are hinged together, and means are provided for opening the segments to enable the lower clamp assembly to be positioned around the upper end portion of a lower pipe section, and the upper clamp assembly to be positioned around the lower end portion of an upper pipe section, whereupon the clamp assemblies can be closed and locked to grasp the respective ends of the pipe sections and thus automatically align the same for threaded engagement. With all or a part of the weight of the upper pipe joint slacked-off on and supported by the upper clamp assembly, the adjustable means then is operated to lower the upper pipe section toward the lower pipe section at a controlled rate of descent while the upper pipe section is rotated by suitable means in order to at least partially make up the threaded connection.

Each clamp assembly is comprised of bowl segments that when closed, clamped and locked provide substantially continuous annular bodies, the upper body having downwardly and inwardly inclined inner surfaces and the lower body having upwardly and inwardly inclined inner surfaces. A plurality of circumferentially spaced slip segments are mounted on each bowl body, the slip segments on the upper body having upwardly facing gripping teeth and inner inclined expander surfaces that are companion in shape to the adjacent upper bowl surfaces. The slip segments on the lower body have downwardly facing gripping teeth and inclined outer surfaces that are companion in shape to the adjacent lower bowl surfaces. The respective sets of slip segments are coupled to a vertical position control ring that can be remotely actuated to cause lateral inward and outward movement of the slip segments with respect to the pipe to be aligned and threaded, and to cause precise axial alignment of the upper and lower pipe joints.

The upper bowl segments are rotatably mounted in a housing and are adapted to be driven by a suitable motor to effect at least partial threaded engagement of the adjacent ends of the pipe joints as the upper pipe joint is lowered with respect to the suspended pipe joint.

It will be recognized that the present invention provides gripping pressure over relatively large areas of the pipe to enable the upper pipe joint to be readily rotated relative to the suspended pipe joint as the threads are made up. The clamp assemblies include gripping elements that are structurally quite rugged and not susceptible to damage when handling heavy casing or other tubular goods.

BRIEF DESCRIPTION OF THE DRAWINGS

The present invention has other features and advantages that will become more clearly apparent in connection with the following detailed description of a preferred embodiment, taken in conjunction with the appended drawings in which.

DESCRIPTION OF A PREFERRED EMBODIMENT

Figure 1:
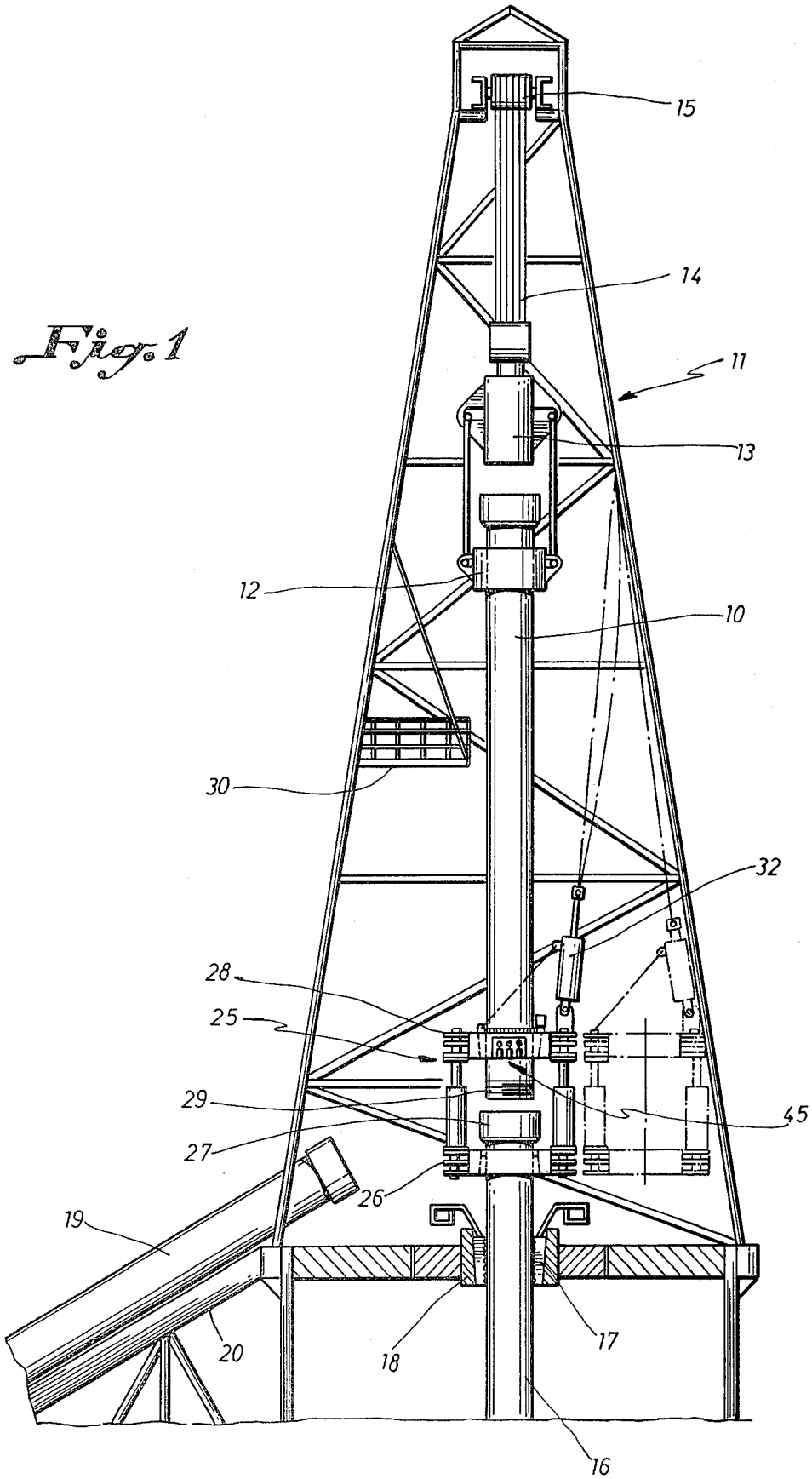
FIG. 1 is a somewhat schematic view of a drill site where tubular goods are being run into the well using the alignment apparatus of the present invention.

Referring initially to FIG. 1, a joint of well casing 10 is shown suspended within the derrick 11 of a drilling rig on elevators 12 that are hung from the traveling block 13. The traveling block 13 is suspended by cable 14 from the crown block 15, and of course the cable is led to a draw works (not shown) on the rig floor that is operated to adjust the vertical position of the elevators 12 and anything hung therefrom within the derrick. A joint of casing 16 that has already been lowered into the well is shown suspended in slips or spider 17 that is positioned in the rotary bushing 18, and another casing joint 19 that eventually will be aligned and threaded to the upper end of the suspended joint 10 is shown resting on the "V" door ramp 20. A pipe alignment apparatus 25 that is constructed in accordance with the principles of the present invention is shown with the lower jaw assembly 26 clamped onto the upper end of the casing joint 16 below its threaded collar 27, and with the upper jaw assembly 28 thereof clamped onto the lower end portion of the suspended casing joint 10 so as to align the lower threaded or pin end 29 thereof for stabbing into the box end of the pipe joint 16 provided by the collar 27. Although the running of well casing is illustrated, other types of tubular goods such as drill pipe and tubing may be run as well.

A stabbing board 30 is attached within the derrick 11 at a considerable distance above the rig floor and provides a work station and walkway for a casing crew member called a "stabber", whose job it is to manuever the pipe joint 10 into axial alignment with the lower joint 16 so that the threaded connection can properly be made. It will be recognized that due to the distance that this station is above the rig floor and to the weight of the pipe, the stabber has rather hazardous duty and normally will attach himself to the board 30 by suitable safety devices.

The alignment tool 25 is suspended within the derrick 11 on a line that is attached to a height adjusting cylinder 32 that can be extended and retracted through use of suitable pneumatic or hydraulic controls. When the tool 25 is not in use, it can be moved to the side of the derrick 11 to an out-of-the-way position shown in dotted lines in FIG. 1 to permit the use of other tools and equipment.

Figure 2:
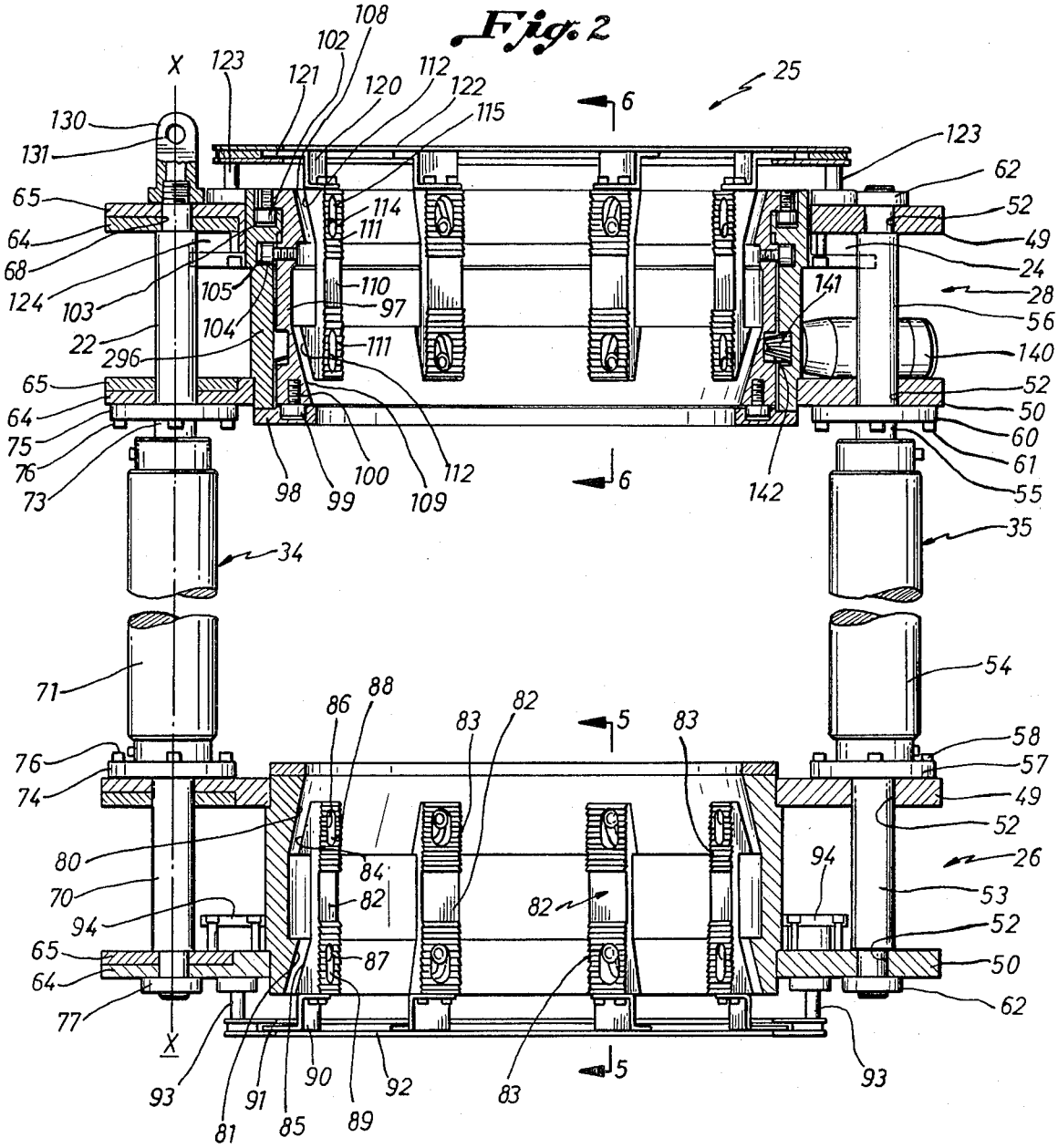
FIG. 2 is a cross-sectional view, with portions in side elevation, of a pipe alignment apparatus in accordance with the present invention.
Figure 4:
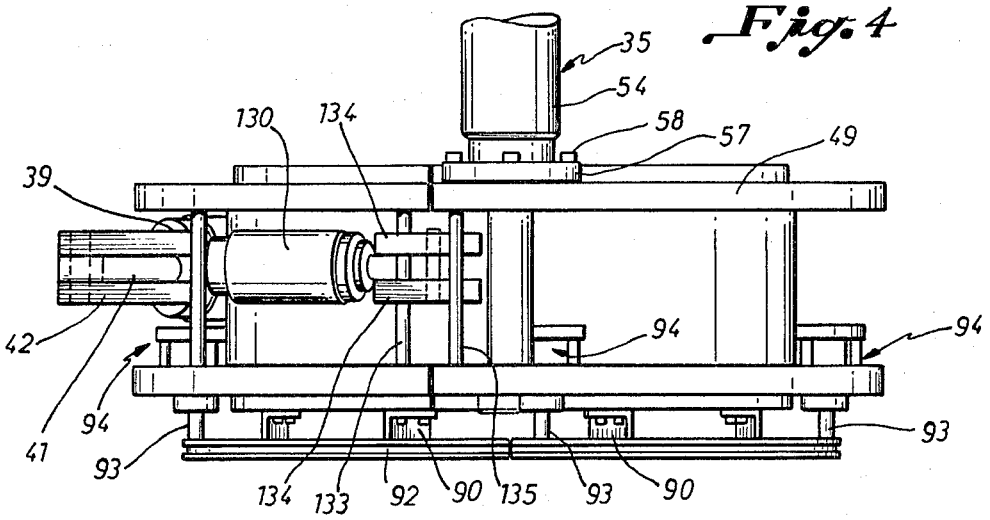
FIG. 4 is a side view of the lower one of the clamp assemblies shown in FIG. 2.
Figure 3:
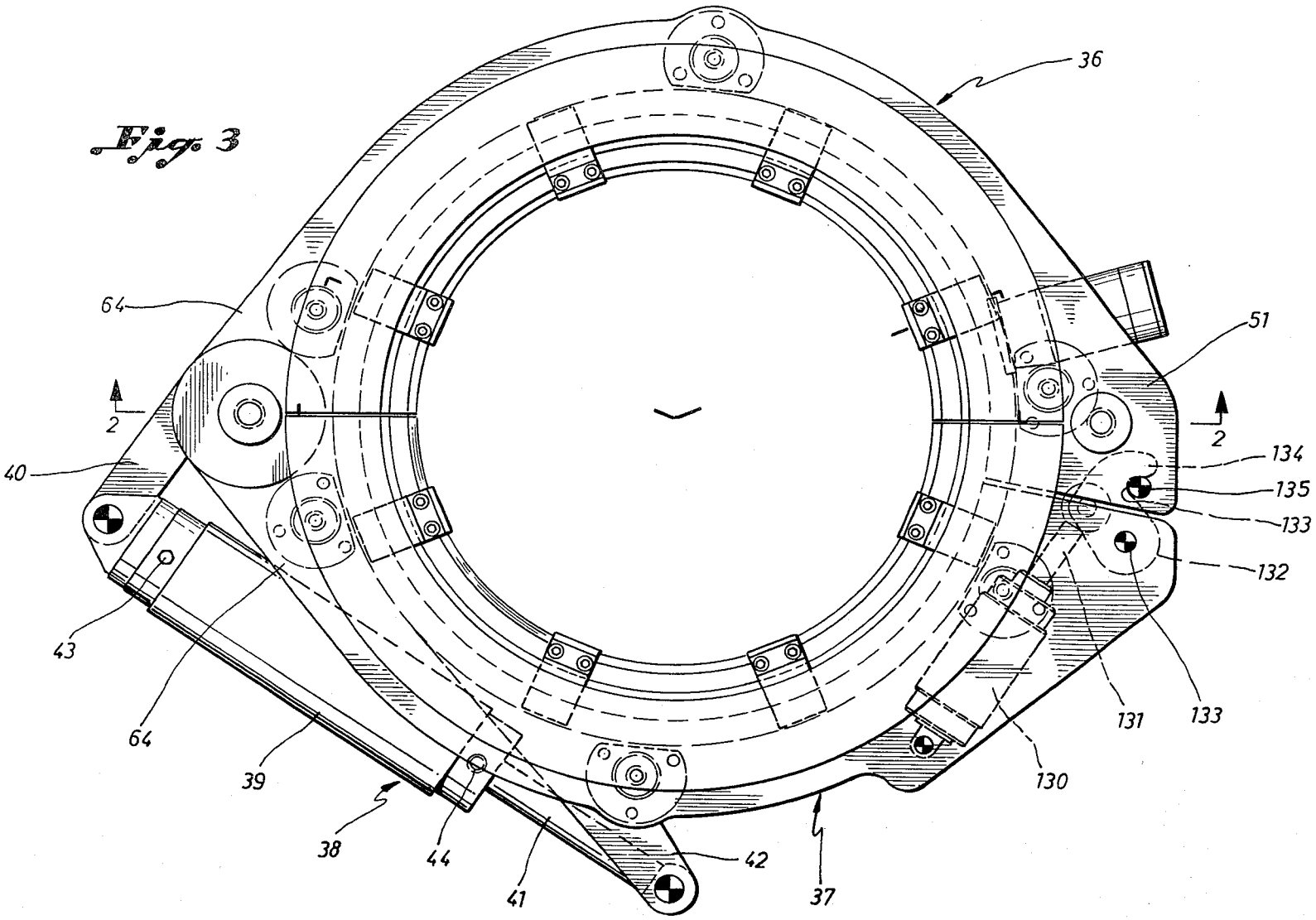
FIG. 3 is a top view of the apparatus shown in FIG. 2.

Turning now to FIGS. 2 and 3 for an illustration of the structural detail of the alignment tool 25, the assembly includes a lower clamp assembly 26 and an upper clamp assembly 28 that are coupled together by diametrically opposed hydraulic rams indicated generally at 34 and 35. The rams 34 and 35 are each double-acting devices that can be selectively extended and retracted in order to adjust the vertical separation of the clamp assemblies 26 and 28. Each of the clamp assemblies comprises a relatively fixed semi-circular segment 36 and a hinged semicircular segment 37 with the center line of the hydraulic ram 34 defining a hinge axis X-X in a manner such that the hinged segments can be individually opened and closed with respect to their companion fixed segments. As shown in FIG. 3, the opening and closing of each hinged segment is controlled by a hydraulic ram 38 having its cylinder 39 pinned to a bracket 40 that is welded or otherwise attached to the fixed segment 36. The piston rod 41 of each ram similarly is pinned to a bracket 42 that is secured to the hinged segment 37, so that extension of the ram will cause the hinged segment to swing toward closed position, and retraction of the ram will cause the hinged segment to swing outwardly and away from the fixed segment to an open position. Hydraulic lines (not shown) are connected to the respective ports 43 and 44 of the cylinder 39 so as to supply and exhaust hydraulic fluid to and from the opposite sides of the piston to effect the extension and retraction of the rod 41. The hydraulic lines extend to an operator control console 45 (FIG. 1) that is provided with a source of fluid under pressure and a typical valving arrangement the details of which will be readily understood by those skilled in the art and need not be set forth in detail herein.

Each of the clamp assemblies 26 and 28 includes a bowl that is divided into semicircular segments, and each segment has arcuate stiffeners or ribs 49 and 50 welded to the upper and lower outer surfaces thereof. Of course it will be recognized that ribs and bowl segments can be formed as integral parts. The end portion 51 of each of the ribs 49 that is located opposite the hinge axis X-X has an aperture 52 formed therein. The apertures 52 in the ribs of the lower clamp assembly 26 receive a shaft 53 that forms a depending extension of the cylinder 54 of the ram 35, and the apertures 52 in the ribs of the upper clamp assembly 28 receive a shaft 56 that forms an extension of the piston rod 55 of the ram 35. The lower end of the cylinder 54 has an outwardly directed flange 57 that is bolted by studs 58 to the end portion 51 of the upper rib 49, and another flange 60 that is appropriately secured to the piston rod 55 similarly is bolted by studs 61 to the end portion of the lower stiffener rib 50. Nuts 62 are threaded to the ends of the respective shafts 53 and 56 in order to secure the cylinder and the rod assemblies to the respective clamp assemblies 26 and 28.

The stiffener rib end portions 64 that are adjacent to the hinge axis X-X are reduced in thickness and arranged in overlapping relationship. Axially aligned holes 68 in the respective end portions 64 and 65 receive a shaft 70 that forms an extension of the cylinder 71 of the ram 34, whereas a like arrangement of rib end portions and holes receives a shaft 72 that forms an extension of the piston rod 73 of the ram. Hereagain the assembly is provided with flanges 74 and 75 that are bolted by studs 76 in a manner to rigidly attach the cylinder 71 to the lower clamp assembly 26 and the piston rod 73 to the upper clamp assembly 28, with a nut 77 being threaded on the lower end of the shaft 70 and a clevis 130 being threaded onto the upper end of the shaft 72. The clevis has a hole 131 for attaching the alignment apparatus 25 to the adjusting cylinder 32 so that the apparatus may be suspended within the derrick as shown in FIG. 1.

Figure 5:
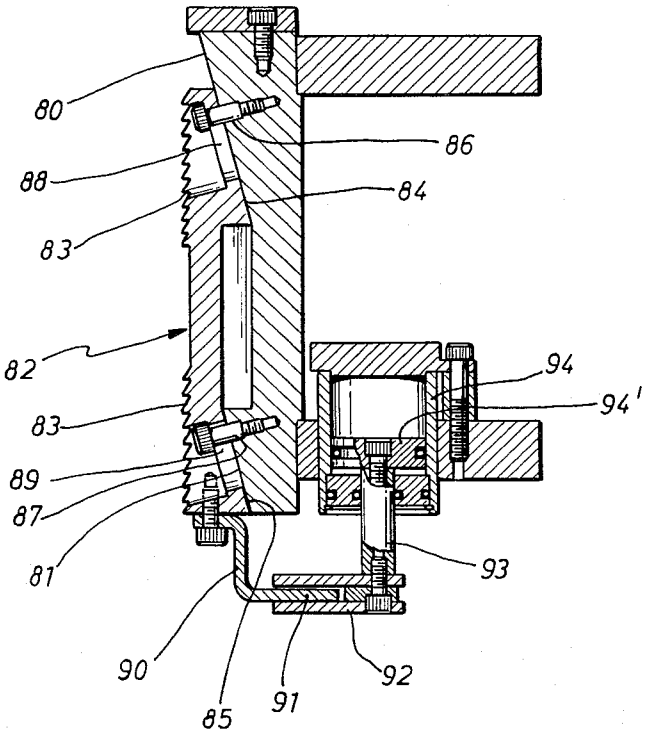
FIG. 5 is an enlarged cross-sectional view of a slip segment, bowl, and position control system that is used in the lower clamp assembly.

As shown in some detail in FIG. 2 and in enlarged detail in FIG. 5, the housing or bowl of the lower clamp assembly 26 has upwardly and inwardly inclined annular surfaces 80 and 81 on which are mounted a set of circumferentially spaced slip segments 82. Each slip segment 82 has downwardly facing wickers or teeth 83 on its arcuate upper and lower inner faces, as well as inclined inner surfaces 84, 85 that are companion in shape to the inclined surfaces 80 and 81 of the bowl. Studs 86, 87 are threaded into the bowl and extend through elongated T-shaped slots 88, 89 in the slip segments 82, with the heads of the studs retaining the segments on the bowl, and the slots enabling limited vertical movement of the slip segment relatively along the bowl. An L-shaped bracket 90 is bolted to the lower end of each slip segment 82, with the horizontal reach 91 of the bracket being loosely received in the internal annular recess of a control ring 92. The control ring 82 is bolted to the rods 93 of several cylinders 94 that are fixed to the lower ribs 50, the rods being connected to pistons 94' that can be selectively subjected to hydraulic pressure from above or below through suitable ports and lines (not shown). Extension of the rods will move the slip segments 82 downwardly relative to the bowl, and retraction of the rods will move the segments upwardly. Of course, downward movement will cause the slip segments to be shifted laterally outwardly, whereas upward movement will cause lateral inward movement thereof.

Figure 6:
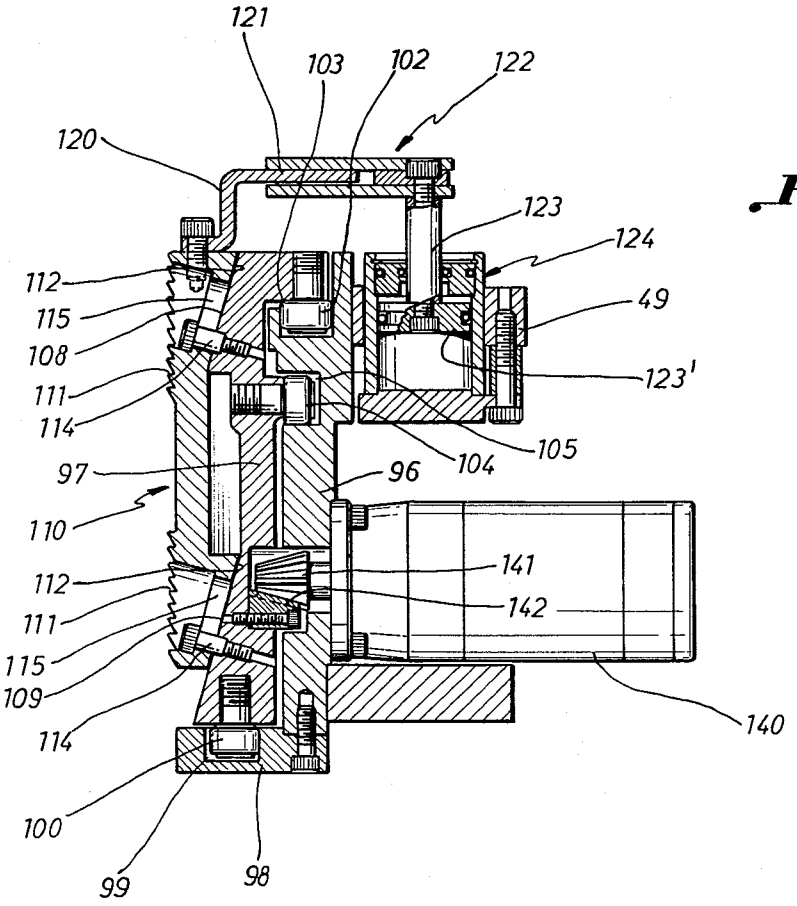
FIG. 6 is a view similar to FIG. 5 of the rotatable gripping structure used in the upper clamp assembly.

As shown in FIGS. 2 and 6, the upper clamp assembly 28 includes a fixed outer bowl 96 and a rotatable inner bowl 97, with each bowl being formed in semicircular sections that together form substantially continuous rings when the clamp assembly is closed around the pipe. An inwardly directed flange 98 that is bolted or otherwise secured to the lower end of the bowl 96 has an upwardly opening guide track 99 that receives the head of guide rollers 100 that are fixed to the lower end of the inner bowl 97 as shown. In a similar fashion, guide rollers 102 are received in an annular, upwardly opening track 103 in the upper end of the outer bowl sections 96. To carry thrust loading, a set of radially directed rollers 104 that ride in an internal recess 105 in the bowl are provided.

The rotatable inner bowl 97 has upwardly and outwardly inclined annular surfaces 108, 109 in which are mounted a set of annularly distributed slip segments 110 that have upwardly facing wickers or teeth 111 on their arcuate inner peripheries and inclined outer surfaces 112 that are companion in shape to the bowl surfaces 108 and 109. Studs 114 that are mounted on the bowl 97 extend through elongated T-shaped slots 115 in each slip segment 110, with the heads of the studs retaining the segments on the bowl, and the slots enabling limited vertical movement of the segments relative to the bowl. An L-shaped bracket 120 is bolted to the upper end of each of each slip segment 110, with the horizontal reach 121 of each bracket being loosely received in an internal annular recess of a control ring 122. The control ring 122 is bolted to the rods 123 of several cylinders 24 that are fixed to the upper ribs 49, the rods being attached to pistons 123' that can be selectively subjected to the pressure of a hydraulic fluid from above or below via suitable ports and lines (not shown). Extension of the rods 123 will move the slip segments 110 upwardly relative to the bowl 97, and retraction of the rods will move the segments downwardly. Of course, upward movement will cause the slip segments 110 to be shifted laterally outwardly, whereas downward movement will cause lateral inward movement thereof.

The upper clamp assembly 28 is provided with a hydraulic drive motor 140, as shown in FIGS. 2 and 6, that is appropriately mounted by studs or the like to an outer bowl 96. The output shaft of the motor 140 is provided with a pinion 141 that meshes with a beveled ring gear 142 that is fixed to the rotatable bowl segments 97. Operation of the motor 140 causes corresponding rotation of the inner bowl 47, the slip segments 110 and the pipe joint that is being engaged by the slip segments.

As shown in FIG. 3, a structure for locking each respective clamp assembly in its closed position includes a hydraulic cylinder 130 pinned to the fixed bowl segment 37 and having its rod 131 pivoted to a latch member 132 that is rotatably mounted on a hinge pin 133. The latch member 132 has a detent 133 and a finger 134 that cooperates with a rod 135 on the hinged bowl segment 36 to capture the rod and thus lock the clamp assembly closed in response to extension of the rod 131. Of course, the retraction of the rod 131 will pivot the latch member 132 away from the lock pin 135 and thereby enable the clamp assembly to be opened.

OPERATION

In operation, the pipe alignment tool 25, which is suspended in the derrick 11 by the line and the height adjusting cylinder 32, is moved over into alignment with the well bore axis. The hydraulic controls at the control console 45 are activated to open the hinged segments 37 of both clamp assemblies 26 and 28. The tool then is positioned such that the lower clamp assembly 26 is located below the collar 27 of the previously run pipe joint 16, whereupon the lower clamp assembly is closed around the pipe and locked closed through actuation of the cylinder 130. The rods 93 are retracted to cause the slip segments 82 to shift laterally inward to positions where the teeth 83 can bit into and thus grip the pipe joint. Since the slips 82 cannot rotate relative to the bowl, the entire tool assembly is at this point rigidly fixed to the upper end portion of the pipe joint 16.

The upper pipe joint 10, which has been suspended from the elevators 12, then is approximately aligned with the axis of the well by the stabber who works on the board 30. The lower end portion of the pipe is positioned within the jaw segments of the upper clamp assembly 28. Then the upper clamp assembly 28 is closed around the lower end portion thereof with the threaded pin end located somewhat above the collar 27 of the lower pipe joint 16. Hereagain the closing motor 130 of the upper clamp assembly 28, which may be either a pneumatic or a hydraulic cylinder, is actuated to cause the latch member 132 and the lock rod 135 to lock the clamp in the closed position, and the cylinders 124 are activated to move the slip segments 110 downward and cause lateral inward shifting thereof into gripping engagement with the pipe. With the slips engaged, it is contemplated that the elevators 12 of the rig can be lowered somewhat so that the entire weight of the pipe joint 10 is slacked off upon, and suspended by, the alignment tool. However, it will be recognized that full support is not necessary to the operation of the tool, and it may be preferable to suspend at least some of the pipe weight from the elevators 12. Either procedure will cause the pipe joint 10 to be precisely axially aligned with the lower pipe joint 16, whereupon the drive motor 140 is activated to cause the pipe joint 10 to begin to turn to the right at a low rpm. Hydraulic fluid then is bled through operation of a needle valve or the like from the rams 34 and 35 below the respective pistons thereof to cause the rams to slowly close or retract, thereby lowering the rotating pin end of the joint 10 toward the stationary box end of the joint 16. As the pin enters the box the threaded connection is at least partially or perhaps even fully made up under power of the motor 140. Then the alignment tool 25 can be released from the pipe joints by retracting the closing motors 130 and actuating the cylinders 39 to open the clamp assemblies 26 and 28. Now the tool 25 can be moved away to the side if it is more desirable to use conventional power tongs or the like to further tighten the joint to a specified make-up torque value.

The hydraulic circuits that are used to actuate the various cylinders and motors for the operator's console are constructed of well-known components and thus need not be described in detail herein.

It now will be recognized that a new and improved pipe alignment apparatus has been provided that is positive and reliable in operation, and structurally quite rugged. Since certain changes or modifications may be made in the disclosed embodiment by those skilled in the art without departing from the inventive concepts involved, it is the aim of the appended claims to cover all such changes and modifications falling within the true spirit and scope of the present invention.

What is claimed is:

1. Apparatus adapted for use in aligning the ends of pipe joints to facilitate the making of a threaded connection therebetween, comprising:

upper and lower clamp assemblies connected together in vertical alignment, said lower clamp assembly carrying a first set of gripping means adapted to engage the upper end portion of a pipe joint that extends downwardly into a well, said upper clamp assembly carrying a second set of gripping means adapted to engage the lower end portion of a pipe joint that initially is suspended above said first-mentioned pipe joint and to support the same, each of said clamp assemblies including pivotally mounted segments that can be opened to permit said end portions to be positioned therein and then closed in order to tightly grip and thereby precisely vertically align said end portions;

means for advancing said upper clamp assembly toward said lower clamp assembly to bring the adjacent ends of said pipe joints into abutting engagement; and means for tightening the engagement of each of said first and second gripping means with said end portions of said pipe joints in response to downwardly directed force, said tightening means for said first gripping means including downwardly and outwardly inclined coengageable surfaces on said lower clamp assembly and said first gripping means whereby downwardly directed force due to the weight of said apparatus and said suspended pipe joint functions to tighten the engagement of said first gripping means with said first-mentioned pipe joint, said tightening means for said second gripping means including downwardly and inwardly inclined coengageable surfaces on said upper clamp assembly and said second gripping means whereby downwardly directed force due to the weight of said suspended pipe joint functions to tighten the engagement of said second gripping means therewith.

2. The apparatus of claim 1 wherein said upper clamp assembly includes inner and outer bowl means, said inner bowl means being mounted for rotation relative to said outer bowl means.

3. The apparatus of claim 2 further including motor means mounted on said outer bowl means for rotating said inner bowl means and said supported pipe joint as the same is advanced toward said first-mentioned pipe joint.

4. The apparatus of claim 1 further including means for extending and retracting each of said first and second gripping means.

5. The apparatus of claim 4 wherein said extending and retracting means includes cylinder means for shifting respective sets of said gripping means axially of said clamp assemblies.

6. Apparatus adapted for use in aligning the ends of pipe joints to facilitate the making of a threaded connection therebetween, comprising:

upper and lower clamp assemblies connected together in vertical alignment, said lower clamp assembly carrying a first set of circumferentially spaced slip elements that are adapted to engage the upper end portion of a pipe joint that extends downwardly into a well, said upper clamp assembly carrying a second set of circumferentially spaced slip elements that are adapted to engage the lower end portion of a pipe joint that initially is suspended above said first-mentioned pipe joint and to support the same as its weight is slacked-off thereon; each of said clamp assemblies including pivotally mounted segments that can be opened to permit said end portions to be positioned therein and then closed in order to cause said sets of slip elements to tightly grip and thereby precisely align said end portions;

means for controllably lowering said upper clamp assembly and said supported pipe joint toward said lower clamp assembly while said support pipe joint is being rotated to bring the adjacent ends of said pipe joints together; and inclined surface means on said slip elements and said clamp assemblies for tightening the engagement of said slip elements with the end portions of said pipe joints responsive to the weight of said supported pipe joint, said surface means on said first set of slip elements and said upper clamp assembly being oppositely inclined with respect to said surface means on said second set of slip elements and said lower clamp assembly.

7. The apparatus of claim 6 further including first selectively operable control means for shifting said first set of slip elements laterally of said upper clamp assembly; and second selectively operable control means for shifting said second set of slip elements laterally of said lower clamp assembly.

8. The apparatus of claim 7 wherein said first control means comprises vertically movable ring means mounted above said first set of slip elements, and means coupling the upper end of each of said slip elements to said ring means.

9. The apparatus of claim 8 wherein said coupling means includes bracket means having a slidable connection to said ring means.

10. The apparatus of claim 7 wherein said second control means comprises vertically movable means mounted below said second set of slip elements, and means coupling the lower end of each of said slip elements to said ring means.

11. The apparatus of claim 10 wherein said coupling means includes bracket means having a slidable connection to said ring means.

12. The apparatus of claim 6 wherein said upper clamp assembly includes inner and outer bowl means, said inner bowl means being mounted for rotation relative to said outer bowl means, said first set of slip elements being carried on said inner bowl means.

13. The apparatus of claim 12 further including selectively operable motor means mounted on said outer bowl means and having gear means meshed with companion gear means on said inner bowl means for rotating said inner blow means and said supported pipe joint as it is being lowered with respect to said first-mentioned pipe joint.

14. The apparatus of claim 13 wherein said motor means is reversible whereby said supported pipe joint can be rotated in either direction as it is being lowered or raised with respect to said first-mentioned pipe joint.

* * * * *

UNITED STATES PATENT AND TRADEMARK OFFICE

CERTIFICATE OF CORRECTION

PATENT NO. : 4,423,648

DATED : January 3, 1984

INVENTOR(S) : Lester W. Toelke

It is certified that error appears in the above-identified patent and that said Letters Patent is hereby corrected as shown below:

Column 1, line 35, delete "weight" and in its place insert --weigh--.
Column 5, line 24, delete "82" and in its place insert --92--.
Column 5, line 52, delete "in" and in its place insert --on--.
Column 5, line 66, delete "24" and in its place insert --124--.
Column 10, line 7, delete "blow" and in its place insert --bowl--.

Signed and Sealed this

*Sixteenth* Day of *April 1985*

[SEAL]

*Attest:*

DONALD J. QUIGG

*Attesting Officer* *Acting Commissioner of Patents and Trademarks*